United States Patent [19]

Adolfsson

[11] Patent Number: 4,509,569

[45] Date of Patent: Apr. 9, 1985

[54] ARRANGEMENT FOR SUPPLYING GAS TO A LIQUID IN A CONTAINER THEREFOR

[75] Inventor: Bengt O. Adolfsson, Stockholm, Sweden

[73] Assignee: Kommanditbolaget Aldolf, Västerås, Sweden

[21] Appl. No.: 463,451

[22] PCT Filed: May 19, 1982

[86] PCT No.: PCT/SE82/00183

§ 371 Date: Jan. 24, 1983

§ 102(e) Date: Jan. 24, 1983

[87] PCT Pub. No.: WO82/04243

PCT Pub. Date: Dec. 9, 1982

[30] Foreign Application Priority Data

May 25, 1981 [SE] Sweden ..... 8103281

[51] Int. Cl.[3] ..... B65B 3/04

[52] U.S. Cl. ..... 141/360; 99/323.1; 222/394; 251/25; 251/77; 261/DIG. 7

[58] Field of Search ..... 141/285–310, 141/360, 361, 362; 222/394, 396, 397, 399; 261/DIG. 7; 251/25, 77, 78; 426/477; 99/323.1, 323.2

[56] References Cited

U.S. PATENT DOCUMENTS

| | | | |
|---|---|---|---|
| 3,170,487 | 2/1965 | Juilfs et al. | 251/25 |
| 3,896,840 | 7/1975 | Andersson | 251/25 |
| 4,304,741 | 12/1981 | Avison et al. | 261/DIG. 7 |
| 4,342,710 | 8/1982 | Adolfsson et al. | 261/DIG. 7 |
| 4,343,824 | 8/1982 | Caldwell | 261/DIG. 7 |
| 4,347,783 | 9/1982 | Ogden | 261/DIG. 7 |

*Primary Examiner*—Houston S. Bell, Jr.

*Attorney, Agent, or Firm*—Sughrue, Mion, Zinn, Macpeak and Seas

[57] ABSTRACT

An apparatus for supplying gas to a liquid in a container (2) having a gas pipe (6) discharging thereinto, the apparatus being particularly intended for preparing aerated beverages. The container comprises an orifice (8) for introducing liquid into the container, an orifice (19) for emptying liquid therefrom, and a gas-venting orifice (13). The emptying orifice (19) which preferably is located in the lower part of the container (2) is provided with a valve (20) which can only be opened when the pressure in the container falls beneath a given value. Suitably the valve is automatically opened by a spring force immediately the pressure falls beneath said given value.

10 Claims, 8 Drawing Figures

ARRANGEMENT FOR SUPPLYING GAS TO A LIQUID IN A CONTAINER THEREFOR

TECHNICAL FIELD

The present invention relates to an arrangement for supplying gas to a liquid in a container having a gas conduit discharging thereinto, particularly for preparing aerated beverages. The container includes an orifice through which liquid is introduced into the container; an orifice through which liquid can be emptied from the container; and a gas-venting orifice.

BACKGROUND ART

For the purpose of preparing aerated beverages on a small scale, for example in the home, apparatuses are known by means of which carbon dioxide can be supplied to water in a bottle, the water then being flavoured with a flavouring substance. In the preparation of such beverages, it is necessary to first fill a bottle with water up to a given level, and then to hold the bottle firmly gripped in the apparatus while supplying carbon dioxide to the water. The bottle is then removed from the apparatus and the flavouring substance added. The beverage is then ready to be poured into a drinking glass or the like.

In addition to being relatively complicated, since among other things it requires the use of a separate bottle whose form and size are adapted to the apparatus in question, the aforedescribed procedure for preparing aerated beverages is also encumbered with other problems and safety risks. Among other things, it is difficult to obtain an accurate seal when using standard bottles, since these bottles can vary greatly in height. In addition, risks are involved when subjecting return bottles to pressure, since in addition to uneven manufacturing quality the bottles may have been damaged during previous use or transportation. Further, in the case of known apparatus the bottle can be pressurized without having been filled with liquid, which presents a risk of serious injury should the bottle explode. It is also possible with known apparatus to overfill the bottle with liquid, rendering it impossible to supply sufficient carbon dioxide to the liquid. In order to aerate a liquid effectively in a container, it is necessary to provide above the surface of the liquid a space in which the gas can be compressed.

It has also been proposed to introduce carbon dioxide into a liquid enclosed in a container fixed in an apparatus, and to pour the aerated liquid directly from the container into a glass. The use of this container is also relatively complicated, however, and in some respects the arrangement is unsafe. Thus, it has been possible to pour liquid from the container while the container still is under high pressure. This can result in the liquid being pressed out into a drinking glass at high rate and splashing out of the glass, or in the glass being flushed away. Further, it has also been possible with this arrangement to pressurize the container when it is empty.

OBJECT OF INVENTION

The main object of the present invention is to provide an apparatus of the kind mentioned in the introduction in which the aforementioned risk of the liquid being flushed out violently in connection with emptying the liquid from the container is eliminated.

BRIEF SUMMARY OF THE INVENTION

This object is fulfilled in accordance with the invention by arranging the pouring orifice which preferably is located in the lower part of the container, so as to open only when the pressure in the container falls below a given value.

The tapping or pouring orifice is suitably provided with a valve which, when being placed in an active state or unblocked, can be automatically opened by a force, preferably a spring force, acting on the valve immediately the pressure in the container falls beneath said given value. This prevents liquid from being unintentionally dispensed from the container when the liquid is under high pressure. This unblocking of the aforementioned valve is suitably effected when an evacuating valve connected to the gas-venting orifice is activated. The arrangement also suitably comprises a metering means which, when activated, opens the evacuating valve and unblocks the pouring valve. The metering means may suitably comprise a lever actuable by a glass or like drinking vessel.

Further, it is preferred that the apparatus is designed so that the container cannot be pressurized without the container being filled with liquid to a given level. Neither shall it be possible to overfill the container, but that a space in which gas can be compressed shall always be present above the surface of the liquid. To obtain this the filling orifice is located in the upper part of the container and provided with a closure means controlled by the level of the liquid in said container and so arranged that a volume of gas is enclosed in the container when the filling orifice is closed by said closure means; and the gas-venting orifice is located in the region of said gas volume.

The closure means associated with the filling opening is suitably arranged to float on the liquid, and preferably has the form of a ball arranged in a pipe which projects downwardly from the filling opening. This arrangement prevents the container from being overfilled and enables the aforementioned volume of gas to be obtained automatically above the surface of the liquid. The filling opening is suitably arranged in the top surface of the container, said top surface being conveniently funnel-shaped to facilitate filling of the container.

Exemplary embodiments of the invention will now be described with reference to the accompanying drawings.

DESCRIPTION OF PREFERRED EMBODIMENTS OF THE INVENTON

Figure 1:
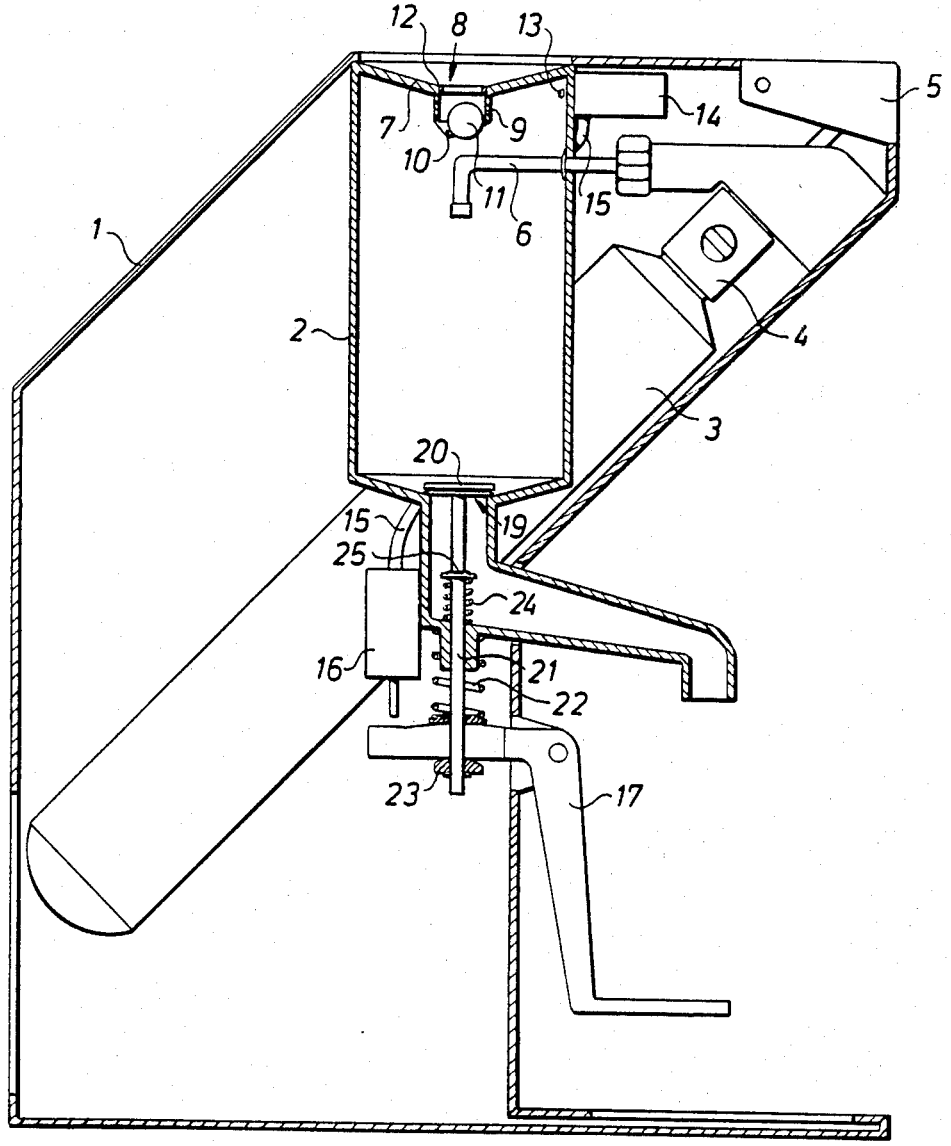
FIG. 1 is an apparatus for preparing aerated beverages, in a rest position, provided with an arrangement according to the invention.
Figure 2:
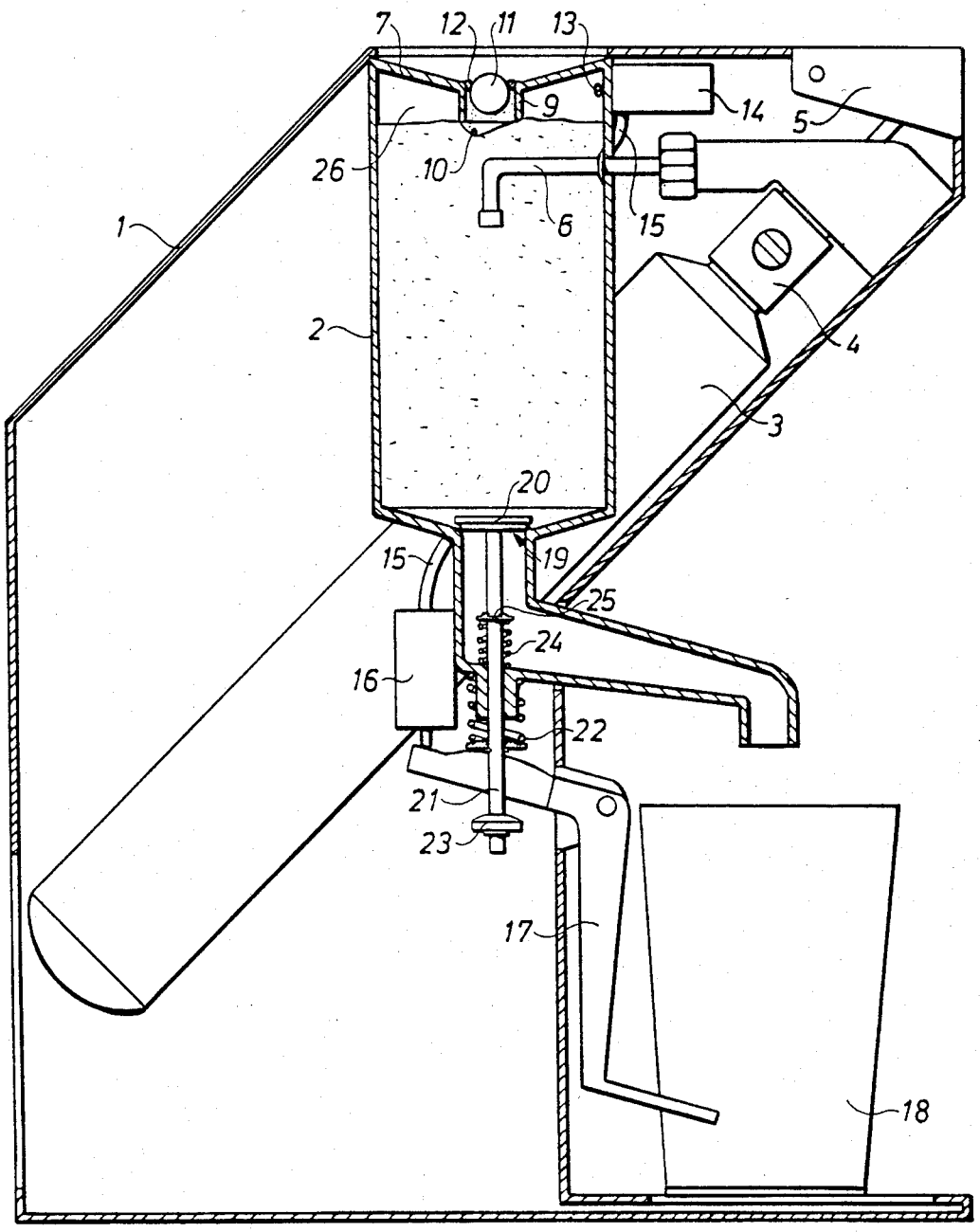
FIG. 2 illustrates the apparatus shown in FIG. 1 during a gas evacuation stage.
Figure 3:
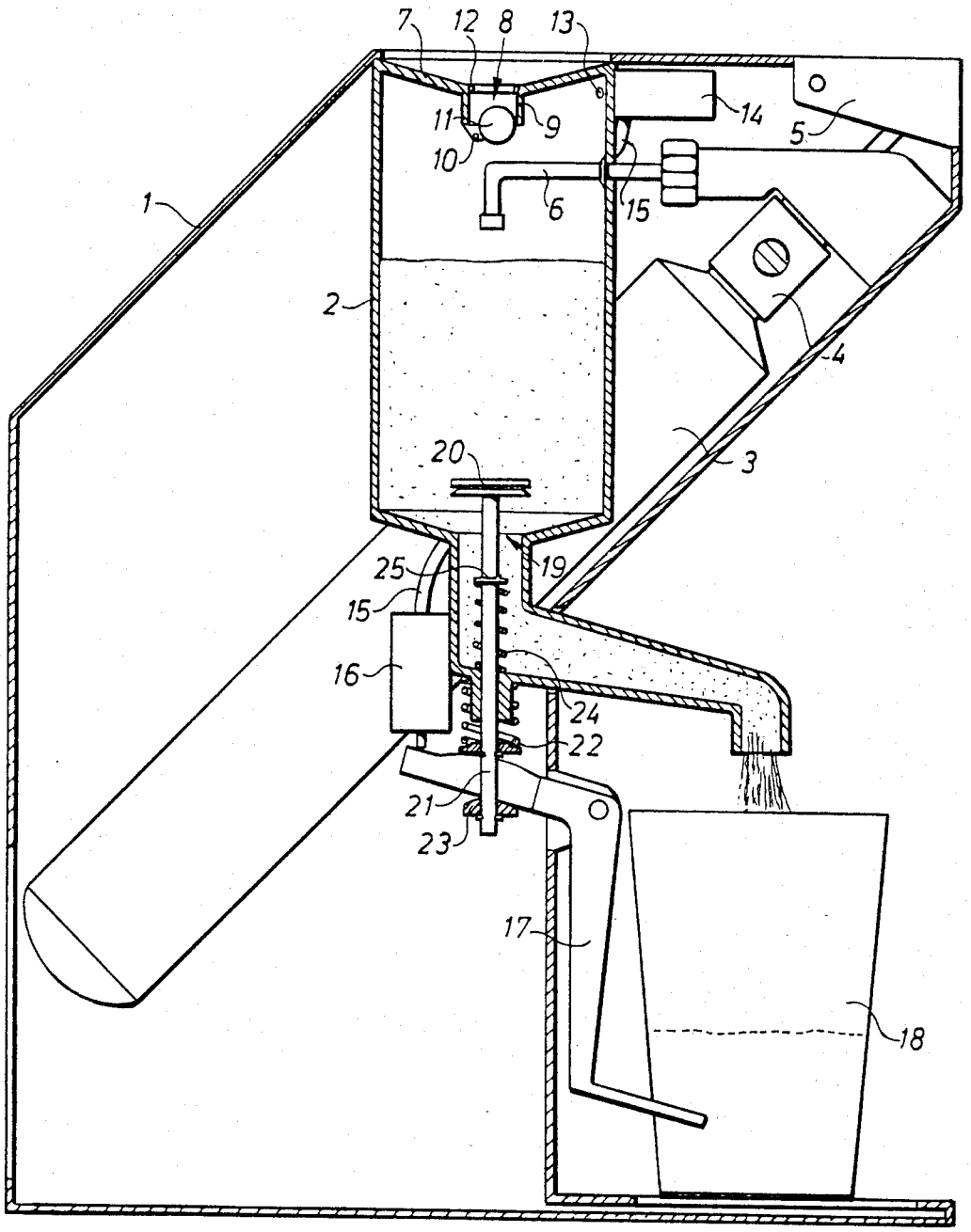
FIG. 3 illustrates the apparatus shown in FIGS. 1 and 2 during a liquid metering stage.

The apparatus illustrated in FIGS. 1–3 comprises a casing 1 which includes a liquid container 2 and a gas bottle or tube 3. The tube 3 is provided with a conventional valve 4, which can be opened by pressing a knob or button 5 for discharging gas through a pipe 6 which opens into the container 2.

The top surface 7 of the container 2 is funnel-shaped and provided with a filling orifice 8 which is surrounded by a downwardly extending pipe 9. Extending across the lower orifice of the pipe 9 is a peg 10 which is excentrically positioned relative to the centre of the pipe 9 to provide a relatively great passage between a portion of the wall of pipe 9 and a ball 11 held in the pipe by the peg 10. Arranged around the filling orifice 8 is an O-ring 12. The upper part of the container 2 is provided with a gas-venting orifice 13, which communicates with a conventional over-pressure relief valve 14 and with a gas-evacuating valve 16 via a pipe 15, said gas-evacuating valve 16 being actuable by means of a lever 17. The lever 17 is suitably bifurcate and arranged to be pressed inwardly by means of a drinking glass 18.

The bottom of the container 2 is provided with a pouring or tapping orifice 19, which can be closed by means of a valve 20. Around the spindle 21 of the valve 20 is arranged firstly a relatively strong compression spring 22, arranged to bias the valve 20 towards its closed position via the lever 17 and a fixed stop 23 on the spindle 21, and secondly a weaker compression spring 24, arranged to work against a fixed abutment 25 on the spindle 21 in order to open the valve 20.

FIG. 1 illustrates the apparatus in its rest position, i.e. there is no liquid in the container 2 to which gas shall be supplied. In this state of the apparatus, the container cannot be placed under pressure, since any gas supplied to the container is able to pass the ball 11, which occupies its lower limit position in the pipe 9, and out through the filling orifice 8. This prevents the container 2 from being subjected to pressures liable to cause the container to explode, when said container contains a large quantity of gas.

When using the illustrated apparatus, the container 2 is filled with water through the filling orifice 8. Filling of the container is facilitated by the funnel-shape configuration of the top surface 7. The water flows down through the filling orifice 8 and past the ball 11, which occupies its lower position. When the level of water reaches the ball 11, however, the ball, which is arranged to float on the water, will be lifted up to seal against the O-ring 12 around the filling orifice, see FIG. 2. As a result of the presence of pipe 9, a volume of air 26 will be enclosed above the surface of the water in the upper part of the container 2. It is only in this position, in which the ball 11 closes the filling orifice 8, that the pressure in the container 2 can be increased by actuating the knob 5 which permits carbon dioxide to be supplied from the tube 3 to the water in the container, through the pipe 6. When introducing carbon dioxide into the water, the knob 5 is depressed a number of times, until the overload or pressure relief valve 14 opens. Opening of the valve takes place when the pressure of the gas in said gas space 26 reaches a pre-set or maximum approved value for the container, and is indicated by means of a distinct sound from the valve 14. Valves of this kind are used in all available types of such apparatus and will not be described in detail.

The creation of the gas space or volume 26, in which part of the gas supplied can be compressed, enables a sufficient quantity of gas to be supplied to the liquid. Alternatively, if the liquid is supplied so as to completely fill the container, no appreciable quantity of gas can be supplied to said liquid, since the pressure therein would rise momentarily to a value at which the overload valve 14 opens.

When wishing to dispense the aerated or carbonated water into a glass 18, the glass is pressed against the lever 17, which compresses the strong spring 22 and opens the evacuation valve 16. When the strong spring 22 is compressed, the second spring 24 endeavours to open the valve 20. The spring 24, however, is dimensioned so that it is unable to open the valve 20 until the pressure in the container 2 has fallen below a predetermined specific level. This prevents liquid from being pressed out of the container under high pressure, which would otherwise cause the liquid to splash out of the glass. Since the lever 17 also opens the evacuation valve 16, however, the pressure in the container 2 will fall rapidly to the pre-selected value, at which the spring 24 is able to open the valve 20. Hence, the water will only be fed from the container 2 by the action of gravity provided that the lever 17 is held depressed, thereby enabling the glass 18 to be readily filled to the desired level, as illustrated in FIG. 3. Any flavouring required is then added directly to the glass, optionally whilst stirring. This eliminates the need of cleaning an additional article, such as the container 2, since it only comes into contact with water and gas.

As will be evident from the aforegoing, the apparatus is very simple to use, since all risks due to error are eliminated. Thus, no liquid can be taken from the container before the pressure therein is such as to enable liquid to be dispensed therefrom in a satisfactory manner. Further, the container cannot be overfilled, since the water can only be filled to a selected level, because the ball 11 automatically closes the opening 8 when this level has been reached. Finally, the container cannot be placed under pressure before it has been filled to said given level. Because of the funnel-shaped top surface 7, it is a simple matter to determine when the container has been filled to the intended level, since when this level is reached water will remain above the filling orifice 8 closed by the ball 11.

Figure 4:
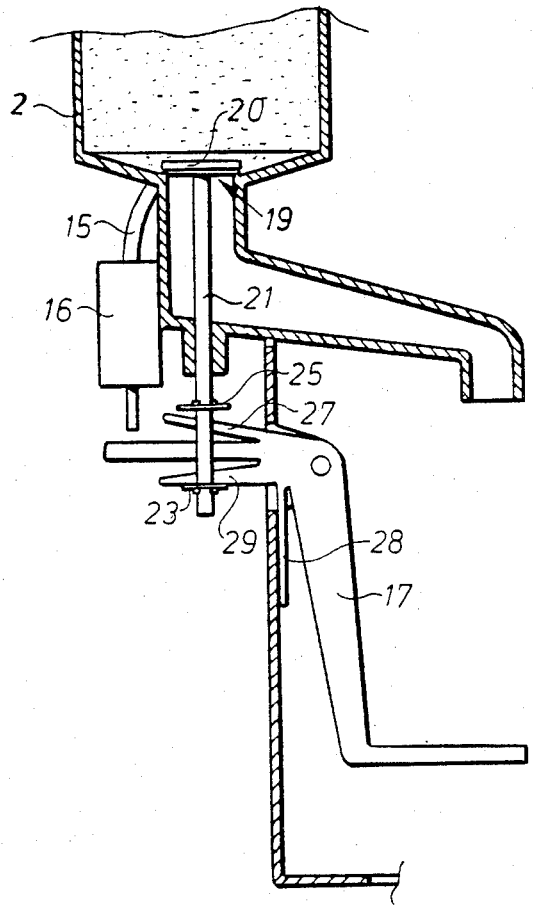
FIG. 4 illustrates an alternative embodiment of the metering means.

FIG. 4 illustrates an alternative embodiment of the lever 17, which in this embodiment comprises a resilient plastics material, such as nylon. In the FIG. 4 embodiment, the springs 22 and 24 of the FIGS. 1–3 embodiment are replaced with two resilient tongues 27 and 28, which together with a further tongue 29 functionally replace the aforementioned springs. The metering means may also be modified in other respects, it being possible, for example, to replace the lever 17 with a knob which when activated opens the evacuating valve 16 and unblocks the valve 20.

In FIGS. 5–8 there is shown a further preferred embodiment of a metering means according to the invention. The metering means is arranged at the lower end of a container 30 which may be provided with an orifice for introducing liquid into the container and a gas conduit discharging thereinto of the same kind as illustrated in FIG. 1.

Figure 5:
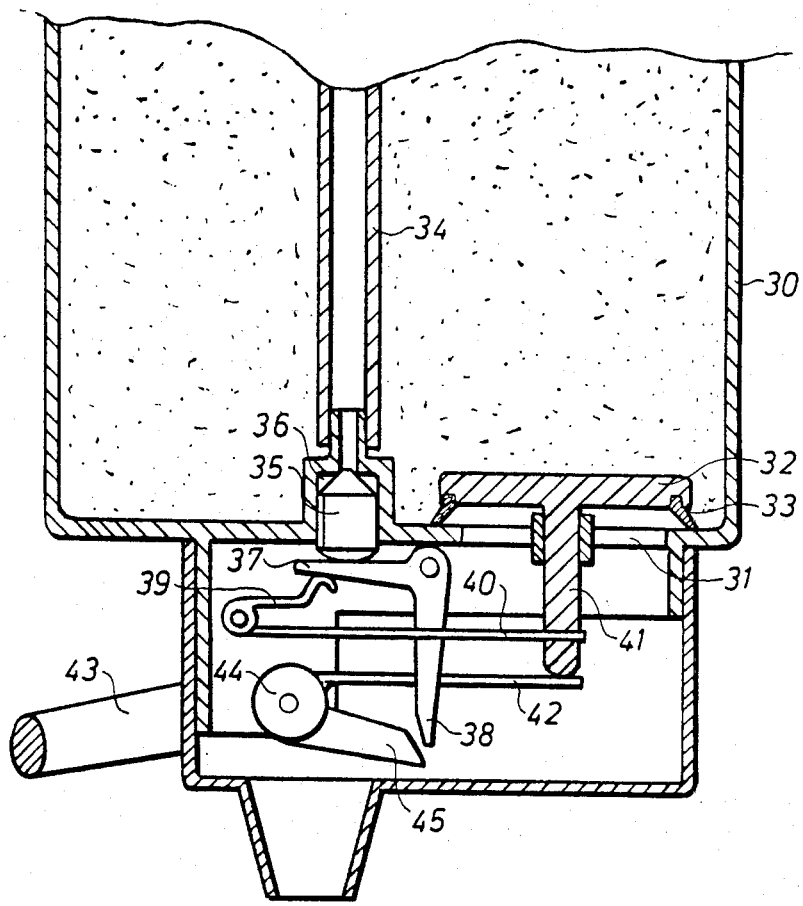
FIGS. 5–8 illustrate a further, preferred embodiment of a metering means according to the invention in different stages.

In FIG. 5 the container is shown filled with water but before carbon dioxide has been introduced into the container. The pouring orifice 31 of the container is closed by means of a valve 32 provided with a circumferential sealing ring 33. A gas pipe is designated 34 the upper end of which (not shown) opens into the gas volume remaining at the upper portion of the container when it is filled with water. At the lower end of the pipe 34 a combined over-pressure relief and evacuating valve 35 is arranged. In FIG. 5 the valve 35 is pressed sealingly against a valve seat 36 by means of the one arm 37 of a knee lever, the other arm of which is designated 38. The arm 37 is pressed against the valve 35 by means of the one branch 39 of a spring element the other branch 40 of which is secured to the valve spindle 41. The branches 39 and 40 tend to diverge resulting in that the valve 35 is subjected to a pressure force directed upwards and the valve 32 is subjected to a pulling force directed downwards. 42 designates a spring tongue which in FIG. 5 is inactive. The tongue 42 is secured to a shaft 44 rotatable by means of a lever 43 to which shaft 44 a finger 45 is also secured.

Figure 6:
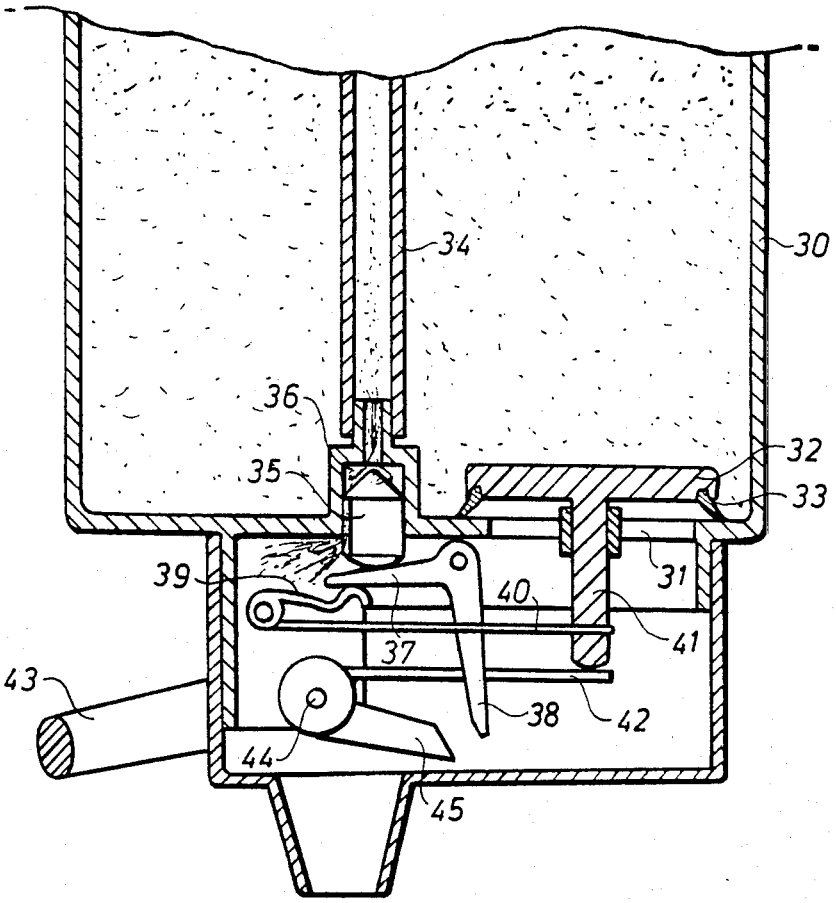

In FIG. 6 the container 30 is shown after that the gas pressure therein has reached a pre-set value which is determined by the spring branch 39. This means that the valve 35 is opened which is indicated by means of a distinct sound generated by the gas flowing out.

Figure 7:
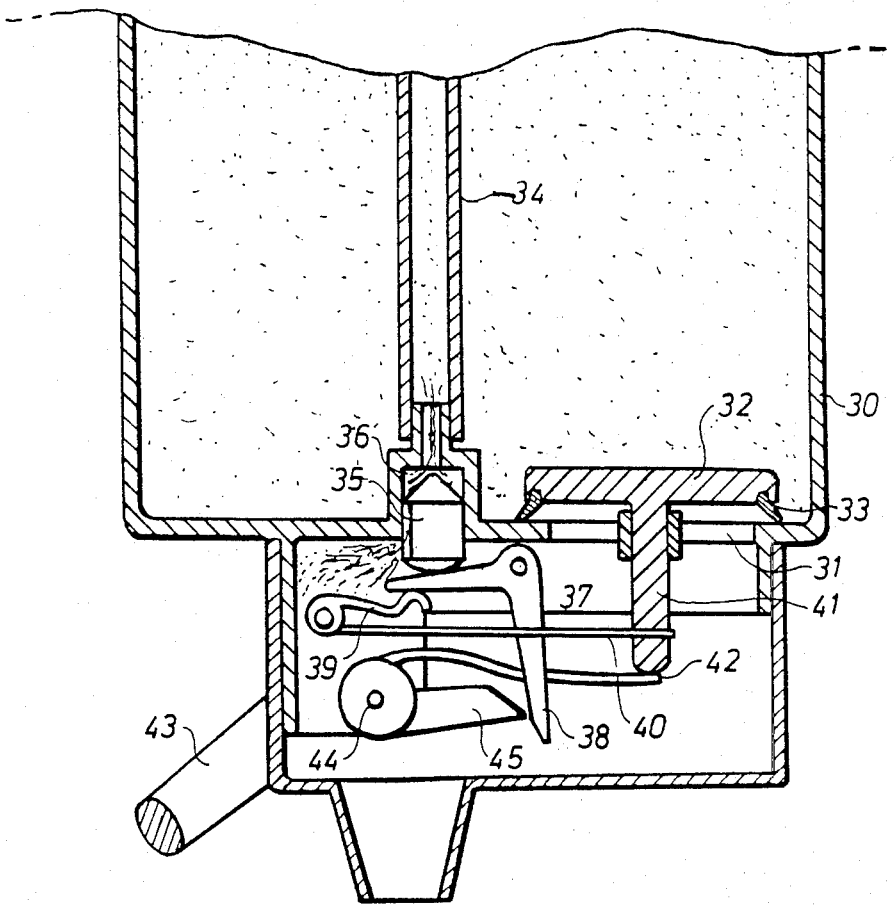
Figure 8:
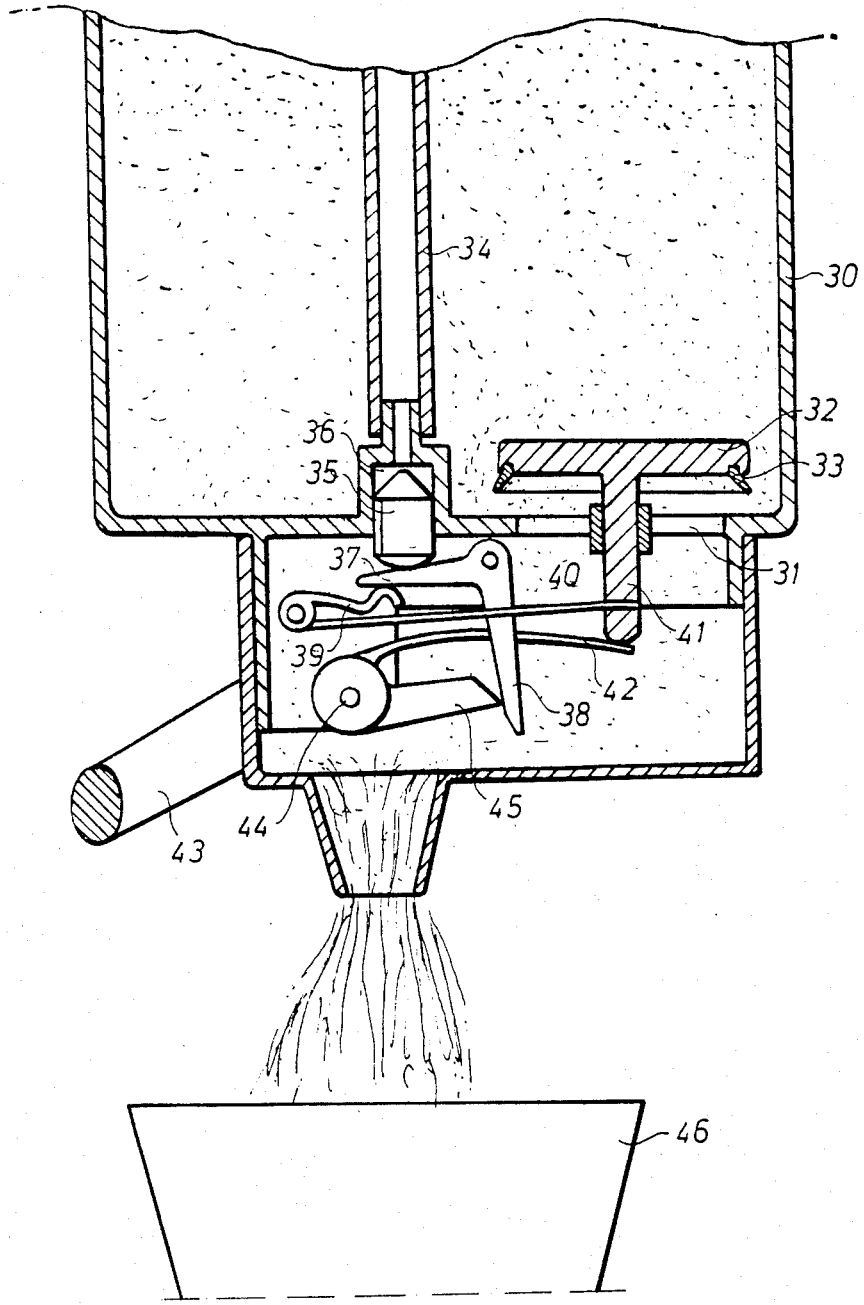

In FIG. 7 the apparatus is illustrated in a stage in which it is desired to take out liquid from the container 30. Then the lever 43 is actuated resulting in that the finger 45 co-operates with the arm 38 for removing the arm 37 from the valve 35 against the action of the spring branch 39. The over-pressure in the container 30 will then be evacuated. As a result of the rotation of the shaft 44 the spring tongue 42 will be pressed against the valve spindle 41 and tend to open the valve 32. However, the spring tongue 42 is so dimensioned that the valve 32 cannot be opened until the pressure in the container falls below a pre-set value. When the pressure falls below said value the valve 32 will automatically be raised by means of the spring tongue 42. This means that the aerated water can pass out through the orifice 31 and down into a drinking glass 46 for instance, see FIG. 8.

Thus, the apparatus just described will operate in the same manner as the apparatus disclosed in FIGS. 1–4. In the apparatus of FIGS. 5–8 the spring branch 40 may be deleted if the weight of the valve 32 is sufficient to gravitationally return the valve to its closed position when the lever 43 is released.

In the above-described apparatus a spring force has been used to open the outlet valve. However, this can also be brought about by means of a magnetic force. In that case the outlet valve is provided with a magnet which is repelled by another magnet provided on a control member. The magnets should be dimensioned such that the magnetic force is unable to open the outlet valve until the pressure in the container falls below a pre-set value. Another way of obtaining the same result is to use a lever of such a design, for instance a very short lever, that the outlet valve cannot be opened by means of said lever until the pressure falls below the desired value.

The apparatus described can also be modified in other respects. For example, the illustrated ball can be replaced by some other suitable closure means arranged to be activated by the level of water in the container. The ball may be replaced by a pivotally mounted closure means, for instance, or closure means mounted in some other suitable fashion, which is lifted by the liquid. As will be understood, the configuration of the apparatus and the positioning of the gas tube may be varied as desired.

I claim:

1. A pressurized apparatus for domestic use for carbonating and dispensing water, comprising:
(a) a water container (2; 30),
(b) a closeable fill orifice (8) for introducing water into the container,
(c) means (3, 4, 5, 6) for supplying pressurized carbon dioxide gas to the container through a discharge outlet disposed below a highest level to which the container may be filled with water,
(d) a normally closed discharge orifice (19; 31) for dispensing carbonated water from the container,
(e) a gas venting orifice (13) disposed in an upper portion of the container above said highest level,
(f) dispenser actuation means (17; 43) for enabling the opening of the discharge orifice, and
(g) means for preventing the opening of the discharge orifice upon the enablement thereof when the pressure in the container exceeds a predetermined value.

2. An apparatus according to claim 1, wherein the preventing means embodies means for automatically opening the discharge orifice when the pressure in the container falls below said predetermined value.

3. An apparatus according to claim 2, wherein:
(a) the discharge orifice includes a valve (20),
(b) the preventing and automatic opening means includes spring means (24; 27) biasing said valve open, and
(c) the dimensions of the valve and the biasing force of the spring means are selected such that the pressure exerted on the valve by the liquid in the container exceeds the biasing force of the spring means when the pressure in the container exceeds said predetermined value.

4. An apparatus according to claims 1, 2 or 3, further comprising an evacuating device (16) connected to the venting orifice and actuated by the dispenser actuation means for reducing the gas pressure in the container to said predetermined value.

5. An apparatus according to claims 1, 2 or 3, wherein the fill orifice is disposed in an upper portion of the container and the discharge orifice is disposed in a lower portion of the container.

6. An apparatus according to claim 5, wherein said enabling means comprises a lever actuable by a drinking glass (18; 46).

7. An apparatus according to claim 1, wherein the fill orifice is located in the upper portion of the container and is provided with a closure means (11) controlled by the level of water in the container, said closure means being so arranged that a volume of gas (26) is trapped in the container when the fill orifice is closed.

8. An apparatus according to claim 7, wherein the closure means is arranged to float on the water.

9. An apparatus according to claim 8, wherein the closure means comprises a ball (11) located in a pipe (9) projecting downwardly from the fill orifice.

10. An apparatus according to claim 7, wherein the fill orifice is disposed in a top surface (7) of the container, and said top surface is funnel-shaped.

* * * * *